United States Patent [19]

De Anda

[11] 3,930,333

[45] Jan. 6, 1976

[54] COUPLING MEMBER FOR A TOY VEHICLE DRIVE SYSTEM

[75] Inventor: Nicholas De Anda, Redondo Beach, Calif.

[73] Assignee: Mattel, Inc., Hawthorne, Calif.

[22] Filed: Dec. 12, 1974

[21] Appl. No.: 531,949

[52] U.S. Cl. ..... 46/202

[51] Int. Cl.[2] ..... A63H 11/10

[58] Field of Search ..... 46/202, 206, 243; 273/86 F; 104/172 R, 172 B, 172 C, 222

[56] References Cited

UNITED STATES PATENTS

| | | | |
|---|---|---|---|
| 2,224,799 | 12/1940 | Schmid | 104/172 B |
| 3,241,263 | 3/1966 | Branstnev | 46/202 |
| 3,473,805 | 10/1969 | Biller | 273/86 F |
| 3,514,108 | 5/1970 | Tepper et al. | 273/86 F |
| 3,545,757 | 12/1970 | Tepper | 46/202 |
| 3,548,534 | 12/1970 | Beny et al. | 104/172 B X |
| 3,552,322 | 1/1971 | Clowes | 104/172 B |
| 3,874,302 | 4/1975 | Grosswhite | 104/172 B |

FOREIGN PATENTS OR APPLICATIONS

| | | | |
|---|---|---|---|
| 684,951 | 12/1952 | United Kingdom | 46/202 |

*Primary Examiner*—Louis G. Mancene
*Assistant Examiner*—J. Q. Lever
*Attorney, Agent, or Firm*—Max E. Shirk

[57] ABSTRACT

A coupling member for a toy vehicle drive system that may be employed in various play situations. The coupling member is generally comprised of an exaggerated triangularly-shaped portion and a funnel-shaped portion. The exaggerated triangularly-shaped portion allows the toy vehicle to be driven forward and backward, and also allows it to complete a U-turn and to be disengaged from the drive chain of the drive system. The funnel-shaped portion ensures that the toy vehicle may be engaged by the driven chain when the child desires to drive the toy vehicle in its forward direction.

7 Claims, 8 Drawing Figures

COUPLING MEMBER FOR A TOY VEHICLE DRIVE SYSTEM

FIELD OF THE INVENTION

This invention relates to toy vehicle play situations, and more particularly to a coupling member for primarily retaining a toy vehicle to a flexible drive chain of a toy play board.

DESCRIPTION OF THE PRIOR ART

Toy vehicle road systems employing toy vehicles that are externally powered by various types of mechanical means have been use for a great number of years. Quite a few approaches have been utilized to attach toy vehicles to external drive means. In some cases, the coupling member permanently retained the toy vehicle to the external drive means and, in other cases, the coupling member allowed the toy vehicle to be disengaged from the external drive means. However, for the most part, these prior systems have become too expensive to employ in modern toy vehicle play situations, or such prior systems have not been reliable for one reason or another, including breakage problems because the systems were not able to survive the normal wear and tear generally imposed upon toys by children.

Accordingly, it is an object of the present invention to provide an inexpensive coupling member for toy vehicles that are not self propelled.

It is a further object of the present invention to provide a drive system for toy vehicles that may be employed in many play situations, for example, in a city traffic play situation or in a country outing play situation.

It is a still further object of the present invention to provide a coupling member for toy vehicles that allows a child to maneuver the toy vehicle so as to make U-turns and also to park the toy vehicle.

It is another object of the present invention to provide a coupling member that is inexpensive, yet durable and highly reliable.

SUMMARY OF THE INVENTION

In accordance with the objects set forth above, this invention provides a coupling member for a toy vehicle drive system that may be employed in various play situations. The coupling member is generally comprised of an exaggerated triangularly-shaped portion and a funnel-shaped portion. The exaggerated triangularly-shaped portion allows the toy vehicle to be driven forward and backward, and also allows it to complete a U-turn and to be disengaged from the drive chain of the drive system. The funnel-shaped portion ensures that the toy vehicle may be engaged by the drive chain when the child desires to drive the toy vehicle in its forward direction.

BRIEF DESCRIPTION OF THE DRAWINGS

Additional objects, advantages and characteristic features of the present invention will become readily apparent from the following description of the preferred embodiments of the invention when taken in conjunction with the accompanying drawings in which.

DESCRIPTION OF THE PREFERRED EMBODIMENTS

Figure 1:
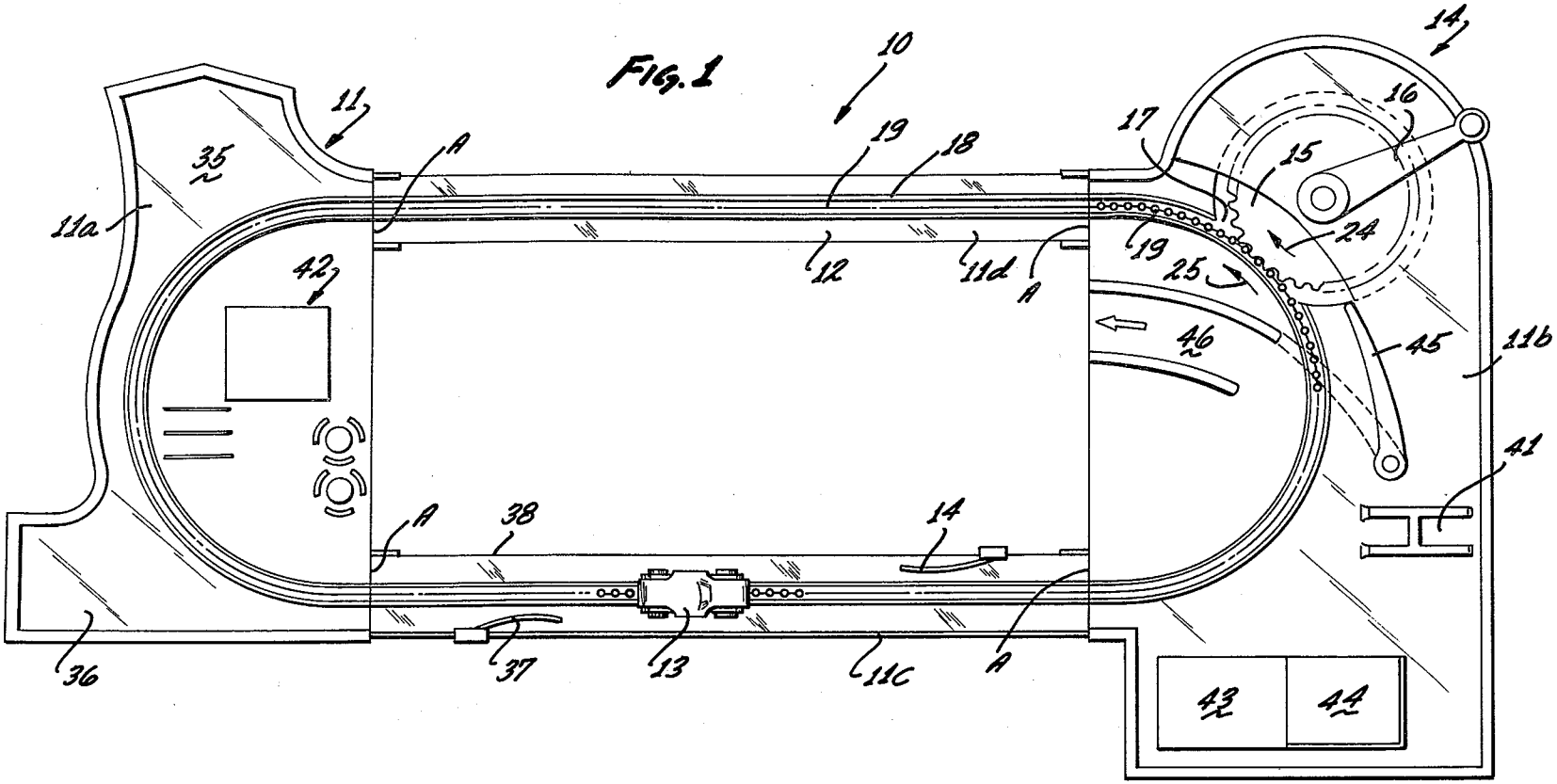
FIG. 1 is a top plan view of a simplified toy vehicle system, illustrated partially in block schematic form, in accordance with the present invention.

Referring now to FIG. 1, there is shown a top plan view of a toy vehicle system 10, illustrated partially in block schematic form, in accordance with the principles of the present invention. The toy vehicle system 10 is generally comprised of a toy play board 11 having a roadway 12 over which a toy vehicle 13 may be driven. It should be understood that this toy play board 11 merely illustrates a simplified version of a toy play situation, and that the toy play board 11 is intended to represent various types of toy play situations, for example, a city traffic play situation, a country outing situation, or a toy racing situation.

Furthermore, the toy play board 11 may be constructed as one piece, or it may be comprised of a plurality of separate pieces that may be connected together. For example, it may be comprised of four separate sections, as defined by the dashed lines A; namely, left end section 11*a*, right end section 11*b*, and the two connecting sections 11*c* and 11*d*.

Further illustrated in FIG. 1 are other components of the toy vehicle system 10, for example, a driven means 14 which is comprised of drive sprocket wheel 15 and a crank 16, a channel 17 that is located within the approximate center portion of the roadway 12, a flexible chain guide 18, and a flexible drive chain 19. The flexible chain guide 18 may be made of plastic material, or the like, and it may be removably placed within the channel 17, except for the portion of the roadway 12 in the immediate proximity of the drive means 14. The flexible drive chain 19 may be made of plastic material or the like, and it is removably retained within the flexible chain guide 18 for the most part.

Figure 2:
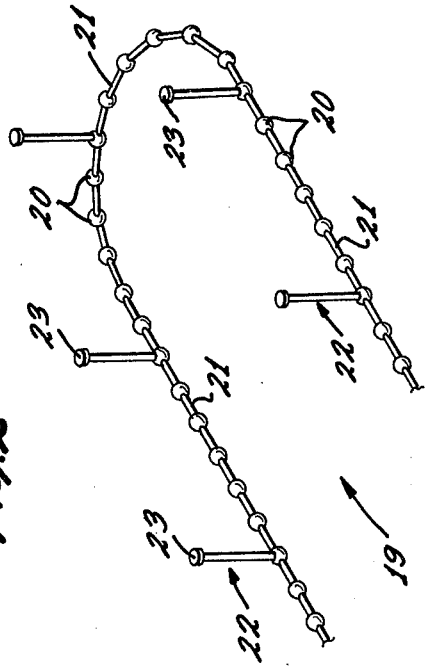
FIG. 2 is a perspective view of a drive chain employed in the toy vehicle system illustrated in FIG. 1 in accordance with the present invention.

Referring now to FIG. 2, there is shown a perspective view of a portion of the flexible drive chain 19 in accordance with the principles of the present invention. The flexible drive chain 19 may be constructed to form an endless flexible drive chain for use in the toy vehicle system 10. The flexible drive chain 19 is generally comprised of a plurality of chain balls 20, a plurality of chain links 21, and a plurality of engaging members 22. The flexible drive chain 19 may be manufactured by various methods to provide a suitable drive chain that is flexible, yet durable to the extent that it may be driven by the drive means 14. As illustrated, the engaging member 22 includes a tab portion 23 on its distal end. It is noted at this time that the engaging members 22 are quite less in number in comparison to the number of chain balls 20. It has been recognized by the Applicants that in most practical toy play situations that the toy vehicles may be driven around the roadway, parked in various areas, and also perform various functions more easily if the engaging members 22 are less in number than the chain balls 20, or in other words, for example, if there are two engaging members 22 for approximately every three inches of drive chain 19, there are four chain balls 20 for approximately every inch of drive chain 19. One main advantage of having spaced engaging members 22 is that a toy vehicle 13, or the like, may be more readily "picked up" by an engaging member 22 after the toy vehicle 13 has become temporarily disengaged. On the other hand, it is noted that for some applications, an equal number of chain balls 20 and engaging members 22 may be more suitable.

Referring again to FIG. 1, it may be readily appreciated by one skilled in the art that the aforementioned components of the drive means 14 may be combined and mounted on the toy play board 11 in a suitable manner and at an appropriate position to drive the flexible drive chain 19. As illustrated, when the drive sprocket wheel 15 is rotated in the clockwise direction, as indicated by the arrow 24, the flexible drive chain 19 is driven in a counterclockwise direction, as indicated by the arrow 25. As may be readily appreciated by one skilled in the art, the respective chain balls 20 are temporarily located between a respective pair of teeth of the drive sprocket wheel 15, and upon rotation of the drive sprocket wheel 15, the flexible drive chain 19 is driven.

Figure 3:
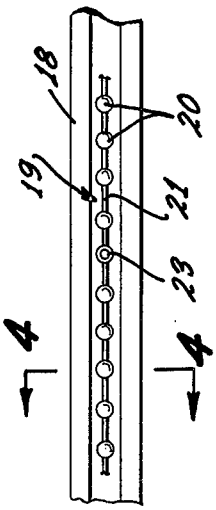
FIG. 3 is a top plan view of the drive chain located within a chain guide in accordance with the present invention.

Briefly referring to FIG. 3, there is shown a top plan view of the flexible drive chain 19 located within the flexible chain guide 18 in accordance with the principles of the present invention.

Figure 4:
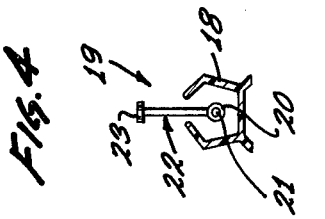
FIG. 4 is a side elevational view of drive chain and drive chain guide taken along the line 4—4 of FIG. 3 in accordance with the present invention.

Referring now to FIG. 4, there is shown a side elevational view of the flexible drive chain 19 and the flexible chain guide 18, taken along the line 4—4 of FIG. 3, in accordance with the principles of the present invention. As illustrated, the chain balls 20 reside in the lower portion of the flexible chain guide 18, and the tab portion 23 of the engaging member 22 is located outside the top of the chain guide 18, as will be more easily understood after reading the discussions relating to FIGS. 5 through 8.

Figure 6:
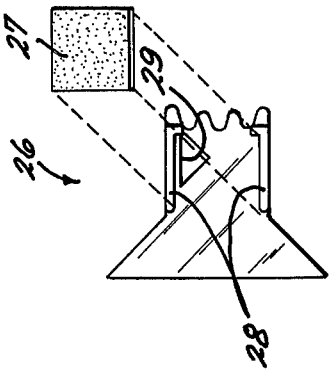
FIG. 6 is a plan view of the top of the coupling member of FIG. 5 in accordance with the present invention.
Figure 8:
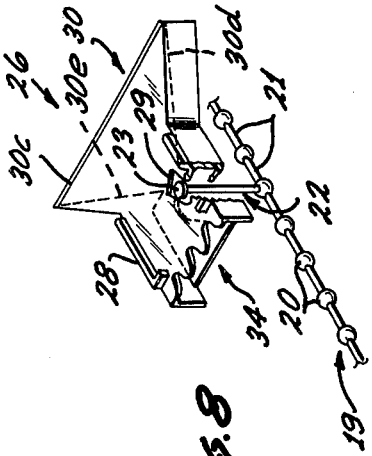
FIG. 8 is an exaggerated perspective view of the coupling member, partially exposed, having an engaging member of the drive chain retained therein, in accordance with the present invention.
Figure 5:
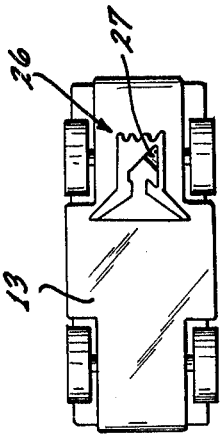
FIG. 5 is a bottom plan view of a toy vehicle having a coupling member attached thereto in accordance with the present invention.

Referring now to FIG. 5, there is shown a bottom plan view of the toy vehicle 13 having a coupling member 26 attached thereto. The coupling member 26 may be attached to the toy vehicle 13 by an adhesive connector 27 that is fully shown in FIG. 6 and partially shown in FIG. 5. Referring now also to FIG. 6, there is shown a plan view of the top of the coupling member 26 and a top view of the adhesive connector 27 of FIG. 5. The coupling member 26 has a pair of placement members 28. The adhesive connector 27 may be of a foam material that is treated with an adhesive substance so that upon affixing one side of the adhesive connector 27 between the pair of placement member 28 and the other side against the bottom side of the toy vehicle 13, the adhesive connector 27 is attached to the toy vehicle 13 as shown in FIG. 5. It is further noted that it has been found that when the adhesive connector 27 is of a desired thickness of foam material, it allows the toy vehicle 13 to be maneuvered more easily on the roadway 12 and also helps to retain the engaging members 22 within the coupling member 26.

Figure 7:
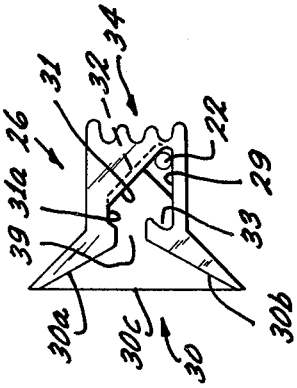
FIG. 7 is a plan view of the bottom of the coupling member of FIG. 5 in accordance with the present invention.

Referring now to FIG. 7, there is shown a plan view of the bottom of the coupling member 26 in accordance with the principles of the present invention. The coupling member 26 is generally comprised of an exaggerated triangularly-shaped portion 29 and a funnel-shaped portion 30. Briefly referring now to FIG. 8, there is shown an exaggerated perspective view of the coupling member 26, partially exposed, to illustrate the retention of a tab portion 23 of an engaging member 22 within the exaggerated triangularly-shaped portion 29.

As illustrated in FIG. 7, an engaging member 22 is resting in proximity of the foremost point of the triangularly-shaped portion 29. In normal operation, the coupling member 26 is located near the front portion, and on the underside, of the toy vehicle 13 as shown in FIG. 5. With an engaging member 22 retained within the coupling member 26, in the position shown in FIG. 7, and upon actuation of the drive means 14 so as to drive the toy vehicle 13 in its forward direction, the engaging member 22 will be primarily urged against a side wall 31 of a raised portion 32 so as to push the toy vehicle 13 around the roadway 12. As long as the velocity of the flexible drive chain 19 is greater than the velocity of the toy vehicle 13, the engaging member 22 will push the toy vehicle around the roadway 12. In most cases, if the operator of the crank 16 temporarily slows down the rotation of the crank 16, the toy vehicle 13 will move forward relative to the position of the engaging member 22 of FIG. 7, in turn, a rear side curved wall 33 of the coupling member 26 will come in contact with the engaging member 22, and the toy vehicle 13 will come to a momentary stop, or a complete stop.

On the other hand, if the operator of the toy vehicle system 10 reverses the rotation of the crank 16, either the engaging member 22 of FIG. 7 will be urged against the rear side curved wall 33 to drive the toy vehicle 13 backwards, or one of the next forwardly located engaging members 22 of the flexible drive chain 19 will come in contact with the front portion 34 of the coupling member 26 to push the toy vehicle in its reverse direction.

As may be readily appreciated at this time, the toy vehicle 13 may be placed on the roadway 12, and upon movement of the flexible drive chain 19 in a direction of travel so as to move the toy vehicle 13 in its forward direction, the funnel-shaped portion 30, as defined by the pair of guiding ridges 30*a* and 30*b*, ensure that an engaging member 22 will enter the coupling member 26 so as to drive the toy vehicle 13. It is further noted that the distal end 30*c* of the funnel-shaped portion 30 is sloped upward as defined by the lines 30*d* and 30*e* of FIG. 8 to further ensure the entry of an engaging member 22 into the coupling member 26.

Referring now to FIG. 1, several maneuvering capabilities of the toy vehicle system 10 will be discussed. For example, if the operator of the toy vehicle system 10 desires to have the toy vehicle 13 perform a U-turn, he drives the toy vehicle 13 past the U-turn area, designated by the numeral 35, in either direction of the roadway 12, then backs the toy vehicle 13 into U-turn area 35, then reverses the direction of travel of the flexible drive chain 19, and the toy vehicle 13 will travel in the opposite direction on the roadway 12. Referring again to the coupling member 26 of FIG. 7, when the toy vehicle is driven past the U-turn area 35 and the direction of flexible drive chain 19 is reversed, the retained engaging member 22 comes in contact with the rear side curved wall 33 to push the toy vehicle 13 backwards into the U-turn area 35. The end of the U-turn area 35 farthest away from the roadway 12 is sloped upward, thus, the toy vehicle 13 tends to remain on, or return to, the flexible drive chain 19. Therefore, upon reversing the direction of the flexible drive chain 19, the retained engaging member 22 seeks to come back to its position shown in FIG. 7, and upon continued rotation of crank 16, the toy vehicle 13 travels forward, in the opposite direction, to complete a U-turn.

Also shown in FIG. 1 is a parking area 36 in the lower left-hand corner of the toy play board 12. Further shown is a deflector member 37 that may be removably attached to the edge of the roadway 12. If the operator of the toy vehicle system 10 desires to park the toy vehicle 13 in the parking area 36, he drives the toy vehicle 13 past the deflector member 37. Upon reversing the direction of travel of the flexible driven chain 19, the toy vehicle 13 travels backwards, and comes in contact with the deflector member 37, and at this time, the retained engaging member 22 is located at a rear end point 31*a* of the side wall 31. Also at this time, the toy vehicle 13 moves sideways towards a raised edge of the track, designated by the numeral 38. The engagement of the respective opposite sides of the toy vehicle 13 with the raised edge 38 and the deflecting force of the deflector member 37 impart a frictional force greater than the frictional force existing between the engaging member 22 and the rear end 31*a* of the side wall portion 31, so that the toy vehicle stops while the flexible drive chain 19 continues to move. Therefore, the retained engaging member 22 travels through a slot 39, of the coupling member 26, thus the toy vehicle 13 is disengaged from the flexible drive chain 19. Then, the next engaging member 22 comes in contact with the front portion 34 of the coupling member 26 to push the toy vehicle 13 into the parking area 36.

Further shown in FIG. 1 is another deflector member 40 and a simulated grease rack 41 which may be utilized in the same fashion as the deflector member 37 and the parking area 36 to park the toy vehicle 13. Thus, by driving the toy vehicle 13 in its forward direction past the deflector member 40, and then backing the toy vehicle 13 past the deflector member 40, the toy vehicle 13 may be parked on the simulated grease rack 41.

Further shown in FIG. 1 for the purpose of understanding of the play value of the toy vehicle system 10 are a simulated drive-in eating area 41, a simulated garage 43 having a parking area 44, and a turnoff ramp lever 45 for guiding the toy vehicle 13 into a turnoff ramp area 46.

Thus, although the present invention has been shown and described with reference to particular embodiments, for example, a removably attached deflector member, various changes and modifications obvious to a person skilled in the art to which the invention pertains, for example, a deflector member affixed to the roadway, are deemed to lie within the spirit, scope and contemplation of the invention as set forth in the appended claims.

What is claimed is:

1. In combination with a toy vehicle, a device for coupling said toy vehicle to an external drive system comprising:

coupling means attached to said toy vehicle, said coupling means having an exaggerated triangularly-shaped portion for retaining a part of said external drive system to facilitate driving of said toy vehicle upon actuation of said external drive system, said exaggerated triangularly-shaped portion being located on the underside of said coupling means and comprising:

1. a side wall located in proximity of the front end of said coupling means, said side wall having a raised portion, a front section, and a rear curve section;
2. a rear side curved wall; and
3. a slot located between said rear curve section and said rear side curved wall, the width of said slot being defined by the respective locations of said rear curve section and said rear side curved wall.

2. A combination as recited in claim 1 wherein upon actuation of said external drive system in a first direction that would push said toy vehicle in its forward direction, the external drive system is urged against said side wall to drive said toy vehicle forward.

3. A combination as recited in claim 2 wherein upon actuation of said external drive system in an opposite direction, said external drive is urged against said rear side curved wall to drive said toy vehicle backwards.

4. A combination as recited in claim 3 wherein upon actuation of said external drive system in said opposite direction, and in cooperation with proper frictional forces on the sides of said toy vehicle, said external drive system will pass through said slot to disengage said toy vehicle from said external drive system.

5. A combination as recited in claim 4 wherein upon the cessation of movement of said external drive system in its first direction, said external drive system will contact said rear side curved wall to stop the travel of said toy vehicle.

6. A combination as recited in claim 1 which further includes a front wall at the extreme front end of said coupling means, said front wall adapted to come in contact with said external drive system to urge said toy vehicle in its backwards direction.

7. In combination with a toy vehicle, a device for coupling said toy vehicle to an external drive system comprising:

coupling means attached to said toy vehicle, said coupling means having an exaggerated triangularly-shaped portion for retaining a part of said external drive system to facilitate driving of said toy vehicle upon actuation of said external drive system, said coupling means including:

1. a funnel-shaped portion; and
2. a slot connecting said funnel-shaped portion to said exaggerated triangularly-shaped portion, said funnel-shaped portion being located to the rear of said exaggerated triangularly-shaped portion and also being closer to the rear end of said toy vehicle, and said funnel-shaped portion adapted to guide said external drive means in contact with said exaggerated triangularly-shaped portion upon proper actuation of said external drive means.

* * * * *